US006182569B1

(12) United States Patent
Rorke et al.

(10) Patent No.: US 6,182,569 B1
(45) Date of Patent: Feb. 6, 2001

(54) LASER-IMAGEABLE PRINTING MEMBERS AND METHODS FOR WET LITHOGRAPHIC PRINTING

(75) Inventors: Thomas P. Rorke, Holyoke; Timothy J. Dunley, Springfield; George R. Hodgins, Granby, all of MA (US)

(73) Assignee: Presstek, Inc., Hudson, NH (US)

( * ) Notice: Under 35 U.S.C. 154(b), the term of this patent shall be extended for 0 days.

(21) Appl. No.: 09/235,933

(22) Filed: Jan. 22, 1999

Related U.S. Application Data

(60) Provisional application No. 60/072,358, filed on Jan. 23, 1998, provisional application No. 60/072,359, filed on Jan. 23, 1998, and provisional application No. 60/101,229, filed on Sep. 21, 1998.

(51) Int. Cl.[7] ..... B41N 1/08

(52) U.S. Cl. ..... 101/457; 101/467

(58) Field of Search ..... 101/453, 454, 101/457, 458, 459, 460, 462, 463.1, 465, 466, 467; 430/302

(56) References Cited

U.S. PATENT DOCUMENTS 5,493,971 * 2/1996 Lewis et al. ..... 101/454
5,605,780 * 2/1997 Burberry et al. ..... 430/278.1
5,985,515 * 11/1999 Van Rompuy et al. ..... 101/457
5,996,498 * 12/1999 Lewis ..... 101/467
6,110,645 8/2000 DeBoer et al. ..... 430/302

FOREIGN PATENT DOCUMENTS

265006 * 10/1997 (JP) .

* cited by examiner

*Primary Examiner*—Stephen R. Funk
(74) *Attorney, Agent, or Firm*—Testa, Hurwitz & Thibeault LLP

(57) ABSTRACT

Provided is a positive working, wet lithographic printing member comprising a hydrophilic metal substrate having disposed thereon a hydrophilic layer, an ablative-absorbing, ink-accepting surface layer and, optionally, an ink-accepting overcoat layer that is not ablative-absorbing. Also provided are methods of preparing such lithographic printing plates, and methods of preparing imaged lithographic printing plates from such lithographic printing plates by imagewise exposure to a laser and a subsequent cleaning step to remove residual laser-induced debris and damaged areas from the hydrophilic layer. The use of water-dispersible carbon blacks with polar groups on the surface of the carbon black and water-based polymers, such as a polyvinyl alcohol, in the ablative-absorbing layer, with the optional addition of the durable, ink-accepting overcoat layer that is not ablative absorbing, improves the ease of the cleaning step and also improves the image resolution, adhesion, and durability upon imaging and use of the printing member.

36 Claims, 3 Drawing Sheets

LASER-IMAGEABLE PRINTING MEMBERS AND METHODS FOR WET LITHOGRAPHIC PRINTING

RELATED APPLICATION

This application claims priority to U.S. Provisional Patent Application Ser. Nos. 60/072,358, titled "Lithographic Printing Plates For Use With Laser Discharge Imaging Apparatus," filed on Jan. 23, 1998; 60/072,359, titled "Lithographic Printing Plates Comprising A Novel Ablatable Layer And Method Of Manufacture Thereof," filed on Jan. 23, 1998; and 60/101,229, titled "Lithographic Printing Plates For Use With Laser Imaging Apparatus," filed on Sep. 21, 1998.

FIELD OF THE INVENTION

The present invention relates in general to lithography and more particularly to systems for imaging lithographic printing plates using digitally controlled laser output. More specifically, this invention relates to a novel lithographic printing plate especially suitable for directly imaging and utilizing with a wet lithographic printing press.

BACKGROUND OF THE INVENTION

Traditional techniques for introducing a printed image onto a recording material include letterpress printing, gravure printing, and offset lithography. All of these printing methods require a plate. To transfer ink in the pattern of the image, the plate is usually loaded onto a plate cylinder of a rotary press for efficiency. In letterpress printing, the image pattern is represented on the plate in the form of raised areas that accept ink and transfer it onto the recording medium by impression. Gravure printing cylinders, in contrast, contain a series of wells or indentations that accept ink for deposit onto the recording medium. Excess ink must be removed from the cylinder by a doctor blade or similar device prior to contact between the cylinder and the recording medium.

The term "lithographic," as used herein, is meant to include various terms used synonymously, such as offset, offset lithographic, planographic, and others. By the term "wet lithographic," as used herein, is meant the type of lithographic printing plate where the printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth, and the like. Commonly the ink is transferred to an intermediate material called the blanket, which in turn transfers the ink to the surface of the material upon which the image is to be reproduced. In a dry lithographic printing system that does not utilize water, the plate is simply inked and the image transferred directly onto a recording material or transferred onto a blanket and then to the recording material.

Aluminum has been used for many years as a support for lithographic printing plates. In order to prepare the aluminum for such use, it is typically subject to both a graining process and a subsequent anodizing process. The graining process serves to improve the adhesion of the image to the plate and to enhance the water-receptive characteristics of the background areas of the printing plate. The graining and anodizing affect both the performance and the durability of the printing plate. Both mechanical and electrolytic graining processes are well known and widely used in the manufacture of lithographic printing plates. Processes for anodizing aluminum to form an anodic oxide coating and then hydrophilizing the anodized surface by techniques such as silication are also well known in the art, and need not be further described herein. The aluminum support is thus characterized by having a porous, wear-resistant hydrophilic surface which specifically adapts it for use in lithographic printing, particularly where long press runs are required.

The plates for an offset press are usually produced photographically. The aluminum substrate described above is typically coated with a wide variety of radiation-sensitive materials suitable for forming images for use in the lithographic printing process. Any radiation-sensitive layer is suitable which, after exposure and any necessary developing and/or fixing, provides an image which can be used for printing. Lithographic printing plates of this type are usually developed with an aqueous alkaline developing solution which often additionally comprises a substantial quantity of an organic solvent.

To prepare a wet plate using a typical negative-working substractive process, the original document is photographed to produce a photographic negative. This negative is placed on an aluminum plate having a water-receptive oxide surface coated with a photopolymer. Upon exposure to light or other radiation through the negative, the areas of the coating that received radiation (corresponding to the dark or printed areas of the original) cure to a durable oleophilic state. The plate is then subjected to a developing process that removes the uncured areas of the coating (i.e., those which did not receive radiation, corresponding to the non-image or background areas of the original), thereby exposing the hydrophilic surface of the aluminum plate.

Throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

As is evident from the above description, photographic platemaking processes tend to be time consuming and require facilities and equipment adequate to support the necessary chemistry. Efforts have been made for many years to manufacture a printing plate which does not require development or which only uses water for development. In addition, practitioners have developed a number of electronic alternatives to plate imaging, some of which can be utilized on-press. With these systems, digitally controlled devices alter the ink-receptivity of blank plates in a pattern representative of the image to be printed. Such imaging devices include sources of electromagnetic radiation, produced by one or more laser or non-laser sources, that create chemical changes on plate blanks (thereby eliminating the need for a photographic negative); ink jet equipment that directly deposits ink-repellent or ink-accepting spots on plate blanks; and spark-discharge equipment, in which an electrode in contact with or spaced closely to a plate blank produces electrical sparks to physically alter the topology of the plate blank, thereby producing "dots" which collectively form a desired image (see, e.g., U.S. Pat. No. 4,911,075). Because of the ready availability of laser equipment and its amenability to digital control, significant effort has been devoted to the development of laser-based imaging systems.

These systems include:

1) Argon-ion, frequency-doubled Nd-YAG and infrared lasers used to expose photosensitive blanks for traditional chemical processing, as for example described in U.S. Pat. Nos. 3,506,779; 4,020,762; 4,868,092; 5,153,236; 5,372,915; and 5,629,354. In an alternative to this approach, a laser has been employed to selectively remove, in an imagewise pattern, an opaque coating that overlies a photosensitive plate blank. The plate is then exposed to a source of radiation, with the unremoved material acting as a mask that prevents radiation from reaching underlying portions of the plate, as for example described in U.S. Pat. No. 4,132,168.

However, the need for high writing speeds, coupled with the constraint of the low-powered lasers favored by industry, has resulted in a requirement for printing plates that have a very high photosensitivity. Unfortunately, high photosensitivity almost always reduces the shelf life of these plates.

2) Another approach to laser imaging uses thermal-transfer materials, as for example described in U.S. Pat. Nos. 3,945,318; 3,962,513; 3,964,389; 4,395,946; and 5,395,729. With these systems, a polymer sheet transparent to the radiation emitted by the laser is coated with a transferable material. The transfer side of this construction is brought into contact with an acceptor sheet, and the transfer material is selectively irradiated through the transparent layer. Irradiation causes the transfer material to adhere preferentially to the acceptor sheet. The transfer and acceptor materials exhibit different affinities for fountain solution and/or ink, so that removal of the transparent polymer sheet with the unirradiated transfer material still on it leaves a suitably imaged, finished plate. Typically, the transfer material is oleophilic, and the acceptor material is hydrophilic.

Plates produced with transfer type systems tend to exhibit short useful lifetimes due to the limited amount of material that can effectively be transferred. Airborne dirt can create an image quality problem depending on the particular construction. In addition, because the transfer process involves melting and resolidification of material, image quality further tends to be visibly poorer than that obtainable with other methods.

3) Other patents describe lithographic printing plates comprising a support and a hydrophilic imaging layer which, upon imagewise laser exposure, becomes oleophilic in the exposed areas while remaining hydrophilic in the unexposed areas, as for example disclosed in U.S. Pat. Nos. 3,793,033; 4,034,183; 4,081,572; and 4,693,958. However, these types of lithographic printing plates suffer from the lack of a sufficient degree of discrimination between oleophilic image areas and hydrophilic non-image areas, with the result that image quality on printing is poor.

4) Early examples utilizing lasers used the laser to etch away material from a plate blank to form an intaglio or letterpress pattern, as for example described in U.S. Pat. Nos. 3,506,779 and 4,347,785. This approach was later extended to production of lithographic plates, e.g., by removal of a hydrophilic surface to reveal an oleophilic underlayer, as for example described in U.S. Pat. No. 4,054,094. These early systems generally required high-power lasers, which are expensive and slow.

More recently, other infrared laser ablation based systems for imaging hydrophilic plates have been developed. These operate by laser-mediated removal of organic hydrophilic polymers which are coated onto an oleophilic substrate such as a polyester/metal laminate or onto an oleophilic polymer coating on a metal support. Use of these materials between the ablation coating and the heat absorbing metal support provides a thermal barrier material which reduces the amount of laser energy required to ablate or physically transform the hydrophilic surface layer, as for example described in U.S. Pat. Nos. 5,353,705; and 5,570,636. Laser output either ablates one or more plate layers, or physically transforms, the oleophobic or hydrophilic surface layer, in either case resulting in an imagewise pattern of features on the plate.

One problem with this approach is that the hydrophilic non-image areas are not sufficiently durable to permit long printing runs, and are easily scratched. Also, the hydrophilic coatings are not like the traditional hydrophilic grained and anodized surfaces and generally are considered outside the mainstream of conventional printing. One other disadvantage of these plates is that they are negative working, since the portions removed by ablation are the image regions that accept ink. When lasers with a large spot size are used for imaging, the size of the smallest printed dot is as large as the spot size. Consequently, the image quality on printing is not high. For example, a 35 micron laser spot size would print its smallest dot size at 35 microns with a negative working plate. On a 200 lines per inch (lpi) halftone screen, this is equivalent to a 5% to 6% dot.

U.S. Pat. No. 5,493,971 extends the benefit of the traditional grained metal plate to ablative laser imaging and also provides the advantage of a positive working plate. These plates are positive working since the portions not removed by ablation are the image regions that accept ink. This construction includes a grained metal substrate, a hydrophilic protective coating which also serves as an adhesion-promoting primer, and an ablatable oleophilic surface layer. The imaging laser interacts with the ablatable surface layer, causing ablation thereof. When lasers with a large spot size are used for imaging, the size of the smallest printed dot can be very small since the large spot size laser beam can be programmed to remove material around a very small area. Although the smallest hole in a solid printed area is large, this does not seriously affect print quality since very small holes in solids tend to fill in with ink. Consequently, the image quality on printing is high. After imaging which removes at least the surface layer and also at least some of the hydrophilic protective layer, the plate is then cleaned with a suitable solvent, e.g., water, to remove portions of the hydrophilic protective layer still remaining in the laser-exposed areas. Depending on the solubility properties of the residual plug of the partially ablated hydrophilic protective layer in the cleaning solvent, including solubility changes from the damage caused by the laser exposure, the cleaning reveals the hydrophilic protective coating at less than its original thickness, or reveals the hydrophilic metal substrate in the cases where the hydrophilic protective coating is entirely removed by the cleaning solvent. After cleaning, the plate behaves like a conventional positive working grained metal wet lithographic plate on the printing press.

However, adhesion of the remaining oleophilic surface coating to the hydrophilic protective layer has proven a difficult problem to overcome. Loss of adhesion can result if the protective hydrophilic thermal barrier layer in the non-image areas of the plate is damaged or degraded during laser imaging. Too much solvent or solubilizing action by the cleaning solution or the fountain solution on press can erode the walls, eliminating the underlying support provided by the hydrophilic barrier layer around the periphery of the image feature and degrading small image elements. This leads to a major loss of image quality. Small dots and type are often removed during cleaning or early in the print run. Efforts to improve the adhesion of the ablatable surface coating and/or its durability to permit longer printing runs typically leads to a significant increase in the laser energy required to image the plate.

U.S. Pat. No. 5,605,780 describes a lithographic printing plate comprising an anodized aluminum support having thereon an oleophilic image-forming layer comprising an infrared-absorbing agent dispersed in a film-forming cyanoacrylate polymer binder. The hydrophilic protective layer has been eliminated. The '780 patent describes low required laser energy, good ink receptivity, good adhesion to the support, and good wear characteristics. Print runs of more than 8,200 impressions are shown in the examples.

Despite the many efforts directed to the development of a laser imageable positive working wet lithographic printing plate, there still remains a need for plates that require no alkaline or solvent developing solution, that look and perform like a conventional lithographic printing plate on press, that are sensitive to a broad spectrum of laser energy (700 nm to 1150 nm), that provide a high resolution image, and that will be long running at high resolution on press (greater than 100,000 impressions).

SUMMARY OF THE INVENTION

One aspect of the present invention pertains to a positive working, wet lithographic printing member imageable by laser radiation comprising (a) an ablative-absorbing, ink-accepting surface layer comprising one or more polymers and a sensitizer, which sensitizer is characterized by absorption of the laser radiation and which surface layer is characterized by ablative absorption of the laser radiation; (b) a hydrophilic layer underlying the surface layer, which hydrophilic layer comprises one or more polymers and is characterized by the absence of ablative absorption of the laser radiation; and, (c) a hydrophilic metal substrate; wherein the surface layer comprises one or more materials selected from the group consisting of: sulfonated carbon blacks having sulfonated groups on the surface of the carbon black, carboxylated carbon blacks having carboxylated groups on the surface of the carbon black, carbon blacks having a surface active hydrogen content of not less than 1.5 mmol/g, and polyvinyl alcohols.

The term "printing member," as used herein, is synonymous with the term "plate" and pertains to any type of printing member or surface capable of recording an image defined by regions exhibiting differential affinities for ink and/or fountain solution. As used herein, for the purpose of determining the weight percent of the polyvinyl alcohol in the ablative-absorbing layer, the term "polymers" includes all the materials which are polymeric film formers, including monomeric species which polymerize or combine with a polymeric species, such as, for example, a monomeric crosslinking agent, to form the polymeric film component of the ablative-absorbing layer.

In one embodiment of the printing members of the present invention, the ablative-absorbing surface layer comprises a sulfonated carbon black having sulfonated groups on the surface of the carbon black. In a preferred embodiment, the sulfonated carbon black is CAB-O-JET 200. In one embodiment, the ablative-absorbing layer comprises a carboxylated carbon black having carboxylated groups on the surface of the carbon black. In one embodiment, the ablative-absorbing surface layer comprises a carbon black having a surface active hydrogen content of not less than 1.5 mmol/g. In a preferred embodiment, the carbon black having a surface active hydrogen content of not less than 1.5 mmol/g is BONJET BLACK CW-1. In one embodiment, the one or more polymers of the ablative-absorbing layer comprises a crosslinked, polymeric reaction product of a polymer and a crosslinking agent. In a preferred embodiment, the crosslinked, polymeric reaction product is selected from the group consisting of: crosslinked reaction products of a crosslinking agent with the following polymers: a polyvinyl alcohol; a polyvinyl alcohol and a vinyl polymer; a cellulosic polymer; a polyurethane; an epoxy polymer; and a vinyl polymer. In one embodiment, the crosslinking agent is a melamine, preferably hexamethoxymethylmelamine.

In one embodiment of the printing members of this invention, the ablative-absorbing surface layer comprises a polyvinyl alcohol. In one embodiment, the polyvinyl alcohol is present in an amount of 20 to 95 percent by weight of the total weight of polymers present in the ablative-absorbing layer. In one embodiment, the polyvinyl alcohol is present in an amount of 25 to 75 percent by weight of the total weight of polymers present in the ablative-absorbing layer. Suitable polymers for use in combination with polyvinyl alcohol in the ablative-absorbing layer include, but are not limited to, other water-soluble or water-dispersible polymers such as, for example, polyurethanes, cellulosics, epoxy polymers, and vinyl polymers. In one embodiment, one or more polymers of the ablative-absorbing layer comprises a crosslinked, polymeric reaction product of a polymer and a crosslinking agent.

In one embodiment, the ablative-absorbing surface layer of the printing members of the present invention is further characterized by being not soluble in water or in a cleaning solution. The term "cleaning solution," as used herein, pertains to a solution used to clean or remove the residual debris from the laser-ablated regions of the printing member and may comprise water, solvents, and combinations thereof, including buffered water solutions, as described for example in U.S. Pat. No. 5,493,971. The term "cleaning treatment," as used herein, pertains to the use of a cleaning solution to remove the residual debris from the laser-ablated regions of the printing member. In a preferred embodiment, the ablative-absorbing surface layer is further characterized by being not soluble in water or in a cleaning solution and by durability on a wet lithographic printing press.

In one embodiment, the thickness of the ablative-absorbing surface layer of the printing members of this invention is from about 0.1 to about 20 microns. In one embodiment, the thickness of the ablative-absorbing layer is from about 0.1 to about 2 microns.

In one embodiment of the printing members of the present invention, the thickness of the hydrophilic layer is from about 1 to about 40 microns. In one embodiment, the thickness of the hydrophilic layer is from about 2 to about 25 microns. In one embodiment, the hydrophilic layer comprises a crosslinked, polymeric reaction product of a hydrophilic polymer and a crosslinking agent. Suitable hydrophilic polymers include, but are not limited to, polyvinyl alcohols and cellulosics. In a preferred embodiment, the hydrophilic polymer is a polyvinyl alcohol.

In one embodiment, the hydrophilic layer is further characterized by being compatible with but not excessively soluble in water or in a cleaning solution, and, preferably, the hydrophilic layer is a thermal barrier or protective layer to protect the substrate from damage from the laser radiation. In one embodiment, the hydrophilic layer is further characterized by being compatible with but not excessively soluble in a cleaning solution, and the ink-accepting surface layer is further characterized by being compatible with but not soluble in a cleaning solution. Compatibility of the hydrophilic layer and water or a cleaning solution, including wetting of the surface of the hydrophilic layer, is important for effectiveness in the cleaning treatment and in running the plate on the printing press. U.S. Pat. No. 5,493,971 describes some of the problems encountered with excessive solubility of the hydrophilic layer in water or in a cleaning solution. These problems include, for example, rapid solubilization of the hydrophilic layer when running on the press and a resultant major loss in image resolution due to undercutting of the ink-accepting surface layer.

In one embodiment of the printing members of this invention, suitable metals for the hydrophilic metal substrate include, but are not limited to, aluminum, copper, steel, and chromium. In a preferred embodiment, the metal substrate is grained, anodized, silicated, or a combination thereof. In one embodiment, the metal substrate is aluminum. In a preferred embodiment, the metal substrate is an aluminum substrate comprising a surface of uniform, non-directional roughness and microscopic depressions, which surface is in contact to the hydrophilic layer and, more preferably, this surface of the aluminum substrate has a peak count in the range of 300 to 450 peaks per linear inch which extend above and below a total bandwidth of 20 microinches.

Another aspect of the present invention pertains to a positive working, wet lithographic printing member imageable by laser radiation comprising (a) a non-ablative-absorbing, ink-accepting surface layer comprising one or more polymers and being characterized by the absence of ablative absorption of said laser radiation; (b) an ablative-absorbing, ink-accepting second layer underlying the surface layer, which second layer comprises one or more polymers and a sensitizer, wherein the sensitizer is characterized by absorption of the laser radiation and the second layer is characterized by ablative absorption of the laser radiation; (c) a hydrophilic third layer underlying the second layer, which third layer comprises one or more polymers and is characterized by the absence of ablative absorption of the laser radiation; and, (d) a hydrophilic metal substrate; wherein the hydrophilic third layer is further characterized by being slightly soluble but not excessively soluble in water and by being at least partially removed by the laser radiation and a subsequent cleaning treatment with water or with a cleaning solution. In one embodiment, the ink-accepting surface layer is further characterized by being hydrophobic and by being compatible with but not soluble in a cleaning solution, the ablative-absorbing second layer does not comprise a polymer and is further characterized by being compatible with but not excessively soluble in the cleaning solution, and the hydrophilic third layer is further characterized by being not excessively soluble in the cleaning solution. In one embodiment, one or more polymers of the ink-accepting surface layer comprises a crosslinked, polymeric reaction product of a polymer and a crosslinking agent. Suitable polymers for forming the crosslinked, polymeric reaction product include, but are not limited to, polyurethanes, cellulosics, polycyanoacrylates, and epoxy polymers. In a preferred embodiment, the crosslinked reaction product of the ink-accepting surface layer is selected from the group consisting of: crosslinked polymer reaction products of a polyurethane and a melamine; and crosslinked polymer reaction products of a polyurethane, an epoxy polymer, and a crosslinking agent. A suitable crosslinking agent includes, but is not limited to, a melamine.

In one embodiment of the printing members of this invention, the ink-accepting surface layer overlying the ablative-absorbing second layer further comprises a catalyst. In one embodiment, the catalyst is an organic sulfonic acid component, preferably a component of an amine-blocked organic sulfonic acid. The term "organic sulfonic acid component," as used herein, pertains to free organic sulfonic acids and also pertains to the free organic sulfonic acids formed when a blocked or latent organic sulfonic acid catalyst is decomposed, such as by heat or by radiation, to form a free or unblocked organic sulfonic acid to catalyze the desired curing reaction, as is known in the art. In a more preferred embodiment, the organic sulfonic acid component is an aromatic sulfonic acid, and, most preferably, p-toluenesulfonic acid.

In one embodiment of the printing members of the present invention, the ink-accepting surface layer overlying the ablative-absorbing second layer is further characterized by being not soluble in water or in a cleaning solution, and, preferably, by durability on a wet lithographic printing press. In one embodiment, the thickness of the ink-accepting surface layer is from about 0.1 to about 20 microns. In one embodiment, the thickness of the surface layer is from about 0.1 to about 2 microns.

In one embodiment of the printing members of the present invention, the ablative-absorbing second layer comprises a carbon black selected from the group consisting of: sulfonated carbon blacks having sulfonated groups on the surface of the carbon black, carboxylated carbon blacks having carboxylated groups on the surface of the carbon black, and carbon blacks having a surface active hydrogen content of not less than 1.5 mmol/g. In one embodiment, the ablative-absorbing second layer comprises a polyvinyl alcohol. In one embodiment, the polyvinyl alcohol is present in an amount of 20 to 95 percent by weight of the total weight of polymers present in the second layer. In one embodiment, the polyvinyl alcohol is present in an amount of 25 to 75 percent by weight of the total weight of polymers present in the second layer. Suitable polymers for use in combination with polyvinyl alcohol in the ablative-absorbing second layer in the printing members of the present invention with an additional non-ablative-absorbing, ink accepting surface layer overlying the ablative-absorbing second layer include, but are not limited to, other water-soluble or water-dispersible polymers such as, for example, polyurethanes, cellulosics, epoxy polymers, and vinyl polymers. In one embodiment, one or more polymers of the ablative-absorbing second layer comprise a crosslinked, polymeric reaction product of a polymer and a crosslinking agent. In one embodiment, the thickness of the ablative-absorbing second layer is from about 0.1 to about 20 microns. In one embodiment, the thickness of the ablative-absorbing second layer is from about 0.1 to about 2 microns.

In one embodiment of the printing members of this invention with an additional non-ablative-absorbing, ink-accepting surface layer overlying the ablative-absorbing second layer, the thickness of the hydrophilic third layer is from about 1 to about 40 microns. In one embodiment, the thickness of the hydrophilic third layer is from about 2 to about 25 microns. In one embodiment, the hydrophilic third layer comprises a crosslinked, polymeric reaction product of a hydrophilic polymer and a crosslinking agent. Suitable hydrophilic polymers include, but are not limited to, polyvinyl alcohols and cellulosics. In a preferred embodiment, the hydrophilic polymer is a polyvinyl alcohol.

In one embodiment of the printing members of this invention with an additional non-ablative-absorbing, ink-accepting surface layer overlying the ablative-absorbing second layer, suitable metals for the hydrophilic substrate include, but are not limited to, aluminum, copper, steel, and chromium. In a preferred embodiment, the metal substrate is grained, anodized, silicated, or a combination thereof. In one embodiment, the metal substrate is aluminum. In a preferred embodiment, the metal substrate is an aluminum substrate comprising a surface of uniform, non-directional roughness and microscopic depressions, which surface is in contact to the hydrophilic layer, and, more preferably, this surface of the aluminum substrate has a peak count in the range of 300 to 450 peaks per linear inch which extend above and below a total bandwidth of 20 microinches.

Another aspect of the present invention pertains to methods of preparing a positive working, wet lithographic printing member imageable by laser radiation, which methods comprise the steps of (a) providing a hydrophilic metal substrate, as described herein; (b) forming a hydrophilic layer on the substrate, which hydrophilic layer comprises one or more polymers and is characterized by the absence of ablative absorption of the laser radiation, as described herein; and, (c) forming an ablative-absorbing, ink-accepting surface layer overlying the hydrophilic layer, which surface layer comprises one or more polymers and a sensitizer, which sensitizer is characterized by absorption of the laser radiation and which surface layer is characterized by ablative absorption of the laser radiation, as described herein; wherein the ablative-absorbing surface layer comprises one or more materials selected from the group consisting of: sulfonated carbon blacks having sulfonated groups on the surface of the carbon black, carboxylated carbon blacks having carboxyl groups on the surface of the carbon black, carbon blacks having surface active hydrogen content of not less than 1.5 mmol/g, and polyvinyl alcohols. In one embodiment, the hydrophilic layer is further characterized by being compatible with but not excessively soluble in a cleaning solution, and the ink-accepting surface layer is further characterized by being not soluble in the cleaning solution. In another embodiment, the hydrophilic layer is a thermal barrier or protective layer to protect the substrate from damage from the laser radiation and is further characterized by being compatible with but not excessively soluble in a cleaning solution, and the ink-accepting layer overlying the hydrophilic layer is further characterized by being not soluble in the cleaning solution.

Still another aspect of this invention pertains to methods of preparing a positive working, wet lithographic printing member imageable by laser radiation, which methods comprises the steps of (a) providing a hydrophilic metal substrate, as described herein; (b) forming a hydrophilic layer on the substrate, which hydrophilic layer comprises one or more polymers and is characterized by the absence of ablative absorption of the laser radiation, as described herein; (c) forming an ablative-absorbing intermediate layer overlying the hydrophilic layer, which intermediate layer comprises one or more polymers and a sensitizer, wherein the sensitizer is characterized by absorption of the laser radiation and the intermediate layer is characterized by ablative absorption of the laser radiation, as described herein; and (d) forming an ink-accepting layer overlying the intermediate layer, which ink-accepting layer comprises one or more polymers and is characterized by the absence of ablative absorption of the laser radiation, as described herein; wherein the hydrophilic layer is further characterized by being slightly soluble but not excessively soluble in water and by being at least partially removed by said laser radiation and a subsequent cleaning treatment with water. In one embodiment, the hydrophilic layer is further characterized by being compatible with but not excessively soluble in a cleaning solution, the ablative-absorbing layer does not comprise one or more polymers and is further characterized by being compatible with but not excessively soluble in the cleaning solution, and the ink-accepting layer is further characterized by being hydrophobic and by being compatible with but not soluble in the cleaning solution.

Yet another aspect of this invention pertains to methods of preparing an imaged wet lithographic printing plate, which methods comprise the steps of (a) providing a positive working, wet lithographic printing member without a non-ablative-absorbing, ink-accepting layer overlying the ablative-absorbing layer, as described herein; (b) exposing the printing member to a desired imagewise exposure of laser radiation to ablate the surface layer of the member to form a residual layer in the laser-exposed areas of the surface layer, which residual layer is in contact to the hydrophilic layer; and, (c) cleaning the residual layer from the hydrophilic layer with a cleaning solution; wherein the hydrophilic layer is characterized by removal of at least a portion of the hydrophilic layer in the laser-exposed areas during steps (b) and (c).

Another aspect of the present invention pertains to methods of preparing an imaged wet lithographic printing plate, which methods comprise the steps of (a) providing a positive working, wet lithographic printing member having a non-ablative-absorbing, ink-accepting layer overlying the ablative-absorbing layer, as described herein; (b) exposing the printing member to a desired imagewise exposure of laser radiation to ablate the ink-accepting surface and ablative-absorbing second layers of the member to form a residual layer in the laser-exposed areas of the ablative-absorbing second layer, which residual layer is in contact to the hydrophilic third layer; and, (c) cleaning said residual layer from the hydrophilic third layer with a cleaning solution; wherein the hydrophilic third layer is characterized by removal of at least a portion of the hydrophilic third layer in the laser-exposed areas during steps (b) and (c).

As one of skill in the art will appreciate, features of one embodiment and aspect of the invention are applicable to other embodiments and aspects of the invention.

The above-discussed and other features and advantages of the present invention will be appreciated and understood by those skilled in the art from the following detailed description and drawings.

BRIEF DESCRIPTION OF THE DRAWINGS

The foregoing discussion will be understood more readily from the following detailed description of the invention when taken in conjunction with the accompanying drawings.

DETAILED DESCRIPTION OF THE INVENTION

Figure 1:
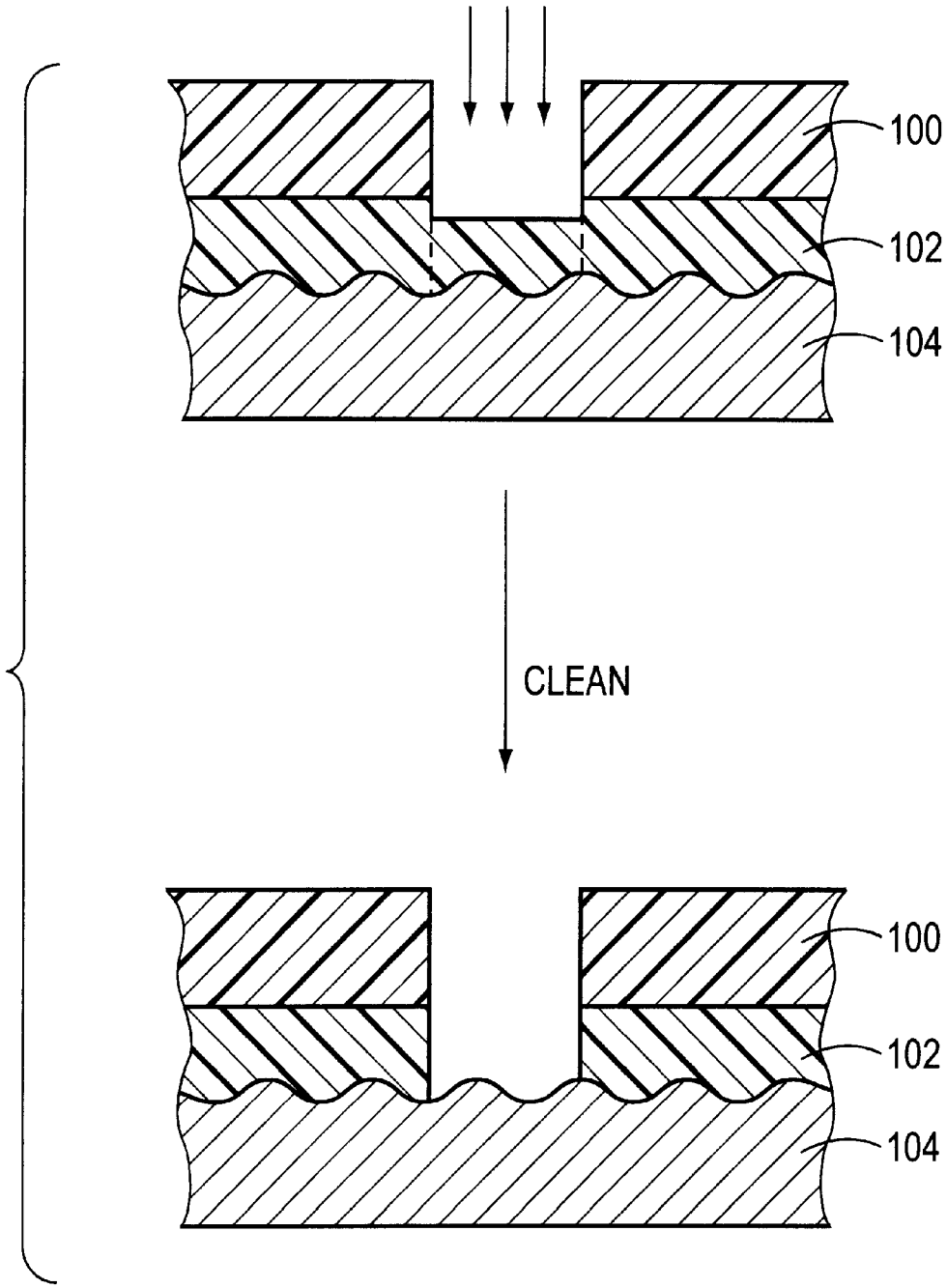
FIG. 1 PRIOR ART
FIG. 1 shows enlarged cross-sectional views of the mechanism, as known in the art, for imaging and cleaning a wet lithographic plate having an absorptive, ablatable top layer, a protective layer, and a grained metal substrate.
Figure 2A:
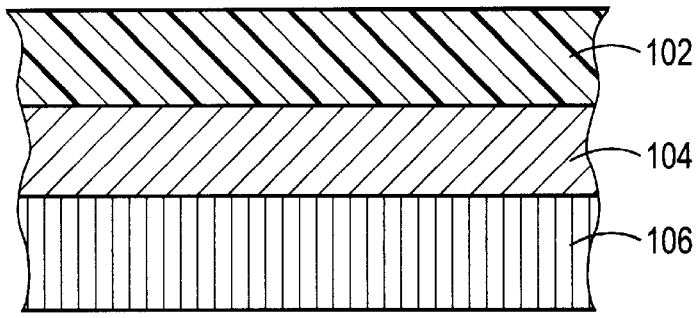
FIG. 2A shows an enlarged cross-sectional view of one embodiment of the wet lithographic printing member of the present invention having an ablative-absorbing, ink-accepting surface layer, a hydrophilic second layer, and a hydrophilic metal support substrate.

Lithographic Printing Plates With Hydrophilic Second Layers and With Ink-Accepting Ablative-Absorbing Surface Layers One aspect of the present invention pertains to a positive working wet lithographic plate imageable by laser radiation as shown in FIG. 2A, comprising a support substrate 106, a hydrophilic layer 104, and an ablative-absorbing, ink-accepting surface layer 102. An example of a support layer, an intermediate polymeric layer, and an ablative-absorbing, ink-accepting layer having this configuration for use as a positive working, wet lithographic printing member imageable by laser radiation is given in the above-referenced U.S. Pat. No. 5,493,971, as illustrated in FIG. 1.

Ablative-Absorbing Surface Layers

Referring to FIG. 2A, the primary characteristics of ablative-absorbing surface layer 102 are vulnerability or sensitivity to ablation using commercially practicable laser imaging equipment, and sufficient adhesion to the hydrophilic second layer 104 to provide long running plates and retention of small 2% and 3% dots in halftone images while running on press. It is also preferable that the ablative-absorbing surface layer 102 produces environmentally and toxicologically innocuous decomposition by-products upon ablation. Vulnerability to laser ablation ordinarily arises from strong absorption in the wavelength region in which the imaging laser emits. It is also advantageous to use polymers having relatively low decomposition temperatures to assist in the heat-induced ablative imaging. Adhesion to the hydrophilic second layer 104 is dependent in part upon the chemical structure and the amount of the material that absorbs the laser radiation and the bonding sites available on the polymers in the ablative-absorbing surface layer 102. It is important that the bonding by the polymers in the ablative-absorbing surface layer 102 is strong enough to provide adequate adhesion to the hydrophilic second layer 104, but is easily weakened during laser ablation and subsequently provides ease of cleaning of the residual debris layer in the ablated areas from the hydrophilic second layer 104. For example, vinyl-type polymers, such as polyvinyl alcohol, strike an appropriate balance between these two properties. Alternatively, vinyl terpolymer dispersion resins or polyurethane dispersion resins in combination with polyvinyl alcohol provides additional durability when on the printing press with a small attendant loss of ease of cleaning and increase in decomposition temperature.

Suitable coatings may be formed by incorporating a water-dispersible carbon black into the coating. For example, a base coating mix is formed by admixture of all components, such as AIRVOL 125 polyvinyl alcohol, a trademark for polyvinyl alcohols available from Air Products, Inc., Allentown, Pa.; UCAR WBV-110 vinyl polymer, a trademark for vinyl polymers available from Union Carbide Corporation, Danbury, Conn.; CYMEL 303 hexamethoxymethyl melamine, a trademark for melamines available from Cytec Corporation, Wayne, N.J.; and CAB-O-JET 200, a trademark for a carbon black dispersions available from Cabot Corporation, Bedford, Mass. A crosslinking catalyst, such as NACURE 2530, a trademark for catalysts available from King Industries, Norwalk, Conn., is subsequently added to the base coating mix just prior to the coating application. Easy cleaning after imaging is provided by use of AIRVOL 125 polyvinyl alcohol incorporated into the ablative-absorbing surface layer 102.

A radiation-absorbing compound or sensitizer is added to the composition of the ablative-absorbing surface layer 102 and dispersed therein. A variety of infrared-absorbing compounds, such as, for example, organic dyes and carbon blacks, are known and may be utilized as the radiation-absorbing sensitizer in the present invention. Of the infrared sensitizers evaluated, CAB-O-JET 200, a trademark for surface modified carbon black pigments available from Cabot Corporation, Bedford, Mass., surprisingly least affected the adhesion to the hydrophilic second layer 104 at the amounts required to give adequate sensitivity for ablation. In other words, CAB-O-JET 200 has good ablation-sensitizing properties, and also allows enhanced adhesion to the hydrophilic second coating layer 104.

The results obtained with CAB-O-JET 200 were better than those obtained with a related compound, CAB-O-JET 300. The CAB-O-JET series of carbon black products are unique aqueous pigment dispersions made with novel surface modification technology, as, for example, described in U.S. Pat. Nos. 5,554,739 and 5,713,988. Pigment stability is achieved through ionic stabilization. The surface of CAB-O-JET 300 has carboxyl groups, while that of CAB-O-JET 200 contains sulfonate groups. No surfactants, dispersion aids, or polymers are typically present in the dispersion of the CAB-O-JET materials. CAB-O-JET 200 is a black liquid, having a viscosity of less than about 10 cP (Shell #2 efflux cup); a pH of about 7; 20% (based on pigment) solids in water; a stability (i.e., no change in any physical property) of more than 3 freeze-thaw cycles at −20° C., greater than six weeks at 70° C., and more than 2 years at room temperature; and a mean particle size of 0.12 microns, with 100% of the particles being less than 0.5 microns. Significantly, CAB-O-JET 200 also absorbs across the entire infrared spectrum, as well as across the visible and ultraviolet regions Another useful radiation-absorbing compound or sensitizer is BONJET BLACK CW-1, a trademark for a surface modified carbon black dispersion available from Orient Corporation, Springfield, N.J. Surprisingly, at the amounts required to give satisfactory sensitivity for ablation, BONJET BLACK CW-1 provided slightly better adhesion to the hydrophilic second layer 104 and reduced odor during ablation than CAB-O-JET 200. BONJET BLACK CW-1 is believed to have a surface active hydrogen content of not less than 1.5 mmol/g and to comprise carboxyl groups among the various active hydrogen group on its surface, as described in U.S. Pat. No. 5,609,671.

Suitable coatings may be formed by known mixing and coating methods, for example, wherein a base coating mix is formed by first mixing all the components, such as water; 2-butoxyethanol; AIRVOL 125 polyvinyl alcohol; UCAR WBV-110 vinyl copolymer; CYMEL 303 hexamethoxymethylmelamine crosslinking agent; and CAB-O-JET 200 carbon black, except for not including any crosslinking catalyst. To extend the stability of the coating formulation, any crosslinking agent, such as NACURE 2530, is subsequently added to the base coating mix or dispersion just prior to the coating application. The coating mix or dispersion may be applied by any of the known methods of coating application, such as, for example, wire wound rod coating, reverse roll coating, gravure coating, and slot die coating. After drying to remove the volatile liquids, a solid coating layer is formed.

The ablative-absorbing surface layer 102 comprises one or more polymers. In one embodiment, the ablative-absorbing surface layer 102 comprises a crosslinking agent. Suitable polymers include, but are not limited to, cellulosic polymers such as nitrocellulose; polycyanocrylates; polyurethanes; polyvinyl alcohols; and other vinyl polymers such as polyvinyl acetates, polyvinyl chlorides, and copolymers and terpolymers thereof. In one embodiment, one or more polymers of the ablative-absorbing surface layer 102 is a hydrophilic polymer. In one embodiment, the crosslinking agent of the ablative-absorbing surface layer 102 is a melamine.

Another aspect of the present invention is the presence of an organic sulfonic acid catalyst in the ablative-absorbing surface layer 102 used for catalyst purposes, such as, for example, 0.01 to 7 weight percent based on the total weight of polymers present in the coating layer for conventional crosslinked coatings. For example, in the aforementioned U.S. Pat. No. 5,493,971, NACURE 2530 is present in Examples 1 to 8 at about a 7 weight percent level as a catalyst for the thermo-set cure of an ablative-absorbing surface layer.

Ablative-absorbing surface layer 102 is typically coated at a thickness in the range of from about 0.1 to about 20 microns and more preferably in the range of from about 0.1 to about 2 microns. After coating, the layer is dried and subsequently cured at a temperature between 135° C. and 185° C. for between 10 seconds and 3 minutes and more preferably cured at a temperature between 145° C. and 165° C. for between 30 seconds to 2 minutes.

In one embodiment, the ablative-absorbing surface layer 102 of the printing member of the present invention is ink-accepting. In one embodiment, the ablative-absorbing surface layer 102 of the printing member of the present invention is characterized by being not soluble in water or in a cleaning solution.

Hydrophilic Second Layers

Referring to FIG. 2A, hydrophilic second layer 104 provides a thermal barrier during laser exposure to prevent heat loss and possible damage to the substrate 106, when the substrate is a metal, such as aluminum. It is hydrophilic so that it may function as the background hydrophilic or water-loving area on the imaged wet lithographic plate. It should adhere well to the support substrate 106 and to the ablative-absorbing surface layer 102. In general, polymeric materials satisfying these criteria include those having exposed polar moieties such as hydroxyl or carboxyl groups such as, for example, various cellulosics modified to incorporate such groups, and polyvinyl alcohol polymers.

Preferably, the hydrophilic second layer 104 withstands repeated application of fountain solution during printing without substantial degradation or solubilization. In particular, degradation of the hydrophilic second layer 104 may take the form of swelling of the layer and/or loss of adhesion to both the ablative-absorbing surface layer 102 and/or to the substrate 106. This swelling and/or loss of adhesion may deteriorate the printing quality and dramatically shorten the press life of the lithographic plate. One test of withstanding the repeated application of fountain solution during printing is a wet rub resistance test. Satisfactory results for withstanding the repeated application of fountain solution and not being excessively soluble in water or in a cleaning solution, as defined herein for the present invention, are the retention of the 3% dots in the wet rub resistance test, as described and illustrated in Example 2 of this invention.

To provide insolubility to water, for example, polymeric reaction products of polyvinyl alcohol and crosslinking agents such as glyoxal, zinc carbonate, and the like are well known in the art. For example, the polymeric reaction products of polyvinyl alcohol and hydrolyzed tetramethylorthosilicate or tetraethylorthosilicate are described in U.S. Pat. No. 3,971,660. Suitable polyvinyl alcohol-based coatings for use in the present invention include, but are not limited to, combinations of AIRVOL 125 polyvinyl alcohol; BACOTE 20, a trademark for an ammonium zirconyl carbonate solution available from Magnesium Elektron, Flemington, N.J.; glycerol, available from Aldrich Chemical, Milwaukee, Wis.; and TRITON X-100, a trademark for a surfactant available from Rohm & Haas, Philadelphia, Pa. The use of BACOTE 20 as a crosslinking agent for polymers at amounts of 5% or less by weight of the polymers is described in Application Information Sheet 117 (Provisional) by P. Moles, titled "The Use of Zirconium in Surface Coatings," available from Magnesium Elektron, Flemington, N.J.

In one embodiment, the hydrophilic second layer 104 of the printing member of the present invention comprises a hydrophilic polymer and a crosslinking agent. Suitable hydrophilic polymers for the hydrophilic second layer 104 include, but are not limited to, polyvinyl alcohol and cellulosics. In a preferred embodiment, the hydrophilic polymer of the third layer is polyvinyl alcohol. In one embodiment, the crosslinking agent is a zirconium compound, preferably ammonium zirconyl carbonate.

In one embodiment, the hydrophilic second layer 104 is characterized by being not excessively soluble in water or in a cleaning solution.

Hydrophilic second layer 104 is coated in this invention typically to a dry thickness in the range of from about 1 to about 40 microns and more preferably in the range of from about 2 to about 25 microns. After coating, the layer is dried and subsequently cured at a temperature between 135° C. and 185° C. for between 10 seconds and 3 minutes and more preferably at a temperature between 145° C. and 165° C. for between 30 seconds and 2 minutes.

Substrates

Suitable substrates for support substrate 106 are hydrophilic metal substrates, including those known in the art as substrates for lithographic printing plates. Since the hydrophilic second layer 104 is damaged during the imaging and subsequently the remaining hydrophilic second layer may be removed entirely during cleaning and with the fountain solution on press, the substrate needs to be hydrophilic to provide the discrimination between the ink-accepting or non-hydrophilic image areas of the surface layer and the water-accepting or hydrophilic background areas of the plate needed for wet lithographic printing. The term, "hydrophilic," as used herein, pertains to the property of a material or a composition of materials that allows it to preferentially retain water or a water-based fountain solution in wet lithographic printing while the non-hydrophilic, ink-accepting materials or composition of materials on the surface of the plate preferentially retain the oily material or ink.

Suitable metals include, but are not limited to, aluminum, copper, steel, and chromium, preferably that have been rendered hydrophilic through graining or other treatments. The printing members of this invention preferably use an anodized aluminum support substrate. Examples of such supports include, but are not limited to, aluminum which has been anodized without prior graining, aluminum which has been grained and anodized, and aluminum which has been grained, anodized, and treated with an agent effective to render the substrate hydrophilic, for example, treatment to form a silicate layer. It is preferred in this invention to use aluminum which has been grained, anodized, and treated with a hydrophilic material.

Figure 2B:
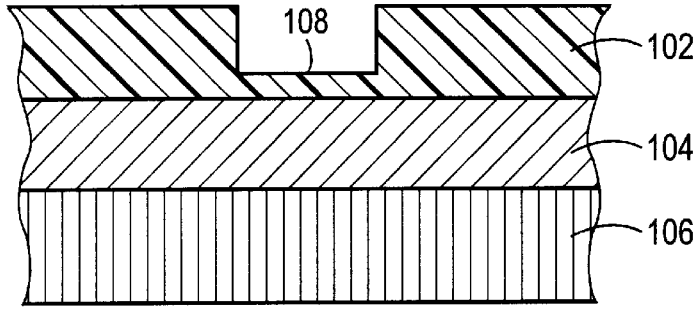
FIGS. 2B, 2C and 2D show enlarged cross-sectional views of the lithographic printing member of FIG. 2A: (B) after imaging; (C) after cleaning; and (D) after running on a wet lithographic printing press.
Figure 2B:
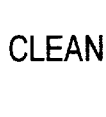
Figure 2C:
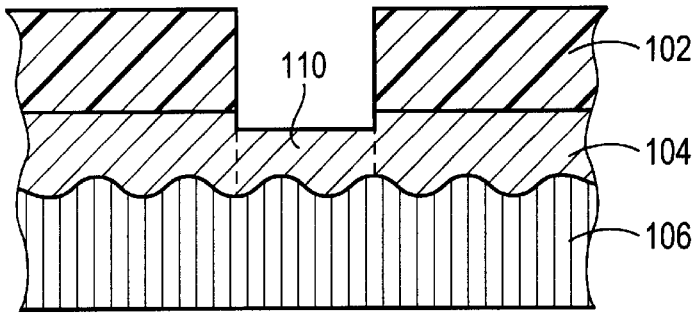
Figure 2D:
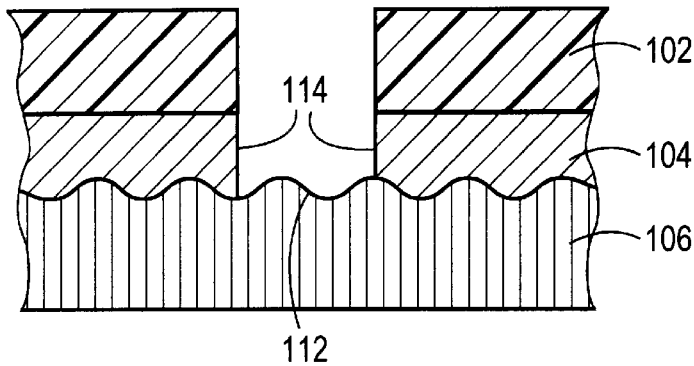

The grain on the aluminum substrate is critical to removal of the residual debris layer 108, as shown in one embodiment in FIG. 2B. If the grain is not uniform with non-directional roughness and without random deep depressions, then many very small particles of residual ink-accepting surface coatings will remain on the surface after cleaning. These will accept ink during the early stages of the printing run and may transfer to the printed sheet. Although these particles may be removed by the ink during the printing run, they extend the necessary run time to achieve an acceptable printed sheet. In one embodiment, the aluminum substrate comprises a surface of uniform, non-directional roughness and microscopic uniform depressions, and, preferably, the aluminum substrate has a peak count in the range of 300 to 450 peaks per linear inch which extend above and below a total bandwidth of 20 microinches, as described in PCT Int. Application Publication No. WO 97/31783. A suitable aluminum substrate having a uniform and non-directional roughness and microscopic uniform depressions includes, but is not limited to, SATIN FINISH aluminum substrate, a trademark for aluminum sheets available from Alcoa, Inc., Pittsburgh, Pa.

Preferred thicknesses for hydrophilic metal substrate 106 range from 0.003 to 0.02 inches, with thicknesses in the range of 0.005 to 0.015 inches being particularly preferred.

Lithographic Printing Members with Three Layers

Figure 3A:
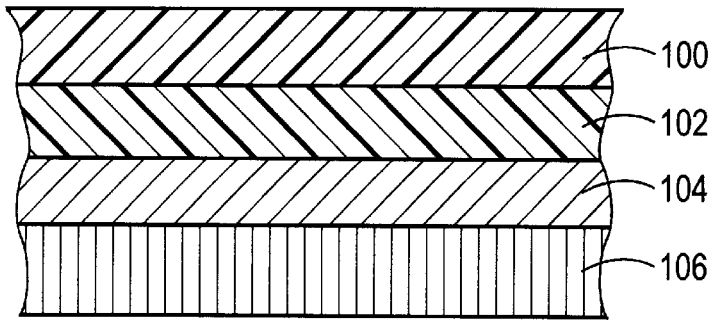
FIG. 3A shows an enlarged cross-sectional view of one embodiment of the wet lithographic printing member of the present invention having an ink-accepting, non-ablative-absorbing surface layer, an ablative-absorbing second layer, a hydrophilic third layer, and a support substrate.
Figure 3B:
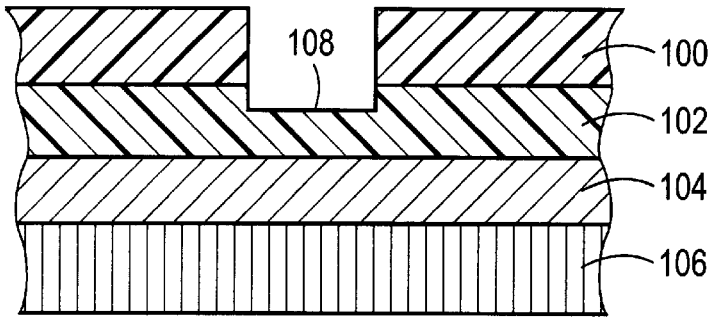
FIGS. 3B, 3C and 3D show enlarged cross-sectional views of the lithographic printing member of FIG. 3A: (B) after imaging; (C) after cleaning; and (D) after running on a wet lithographic printing press.
Figure 3C:
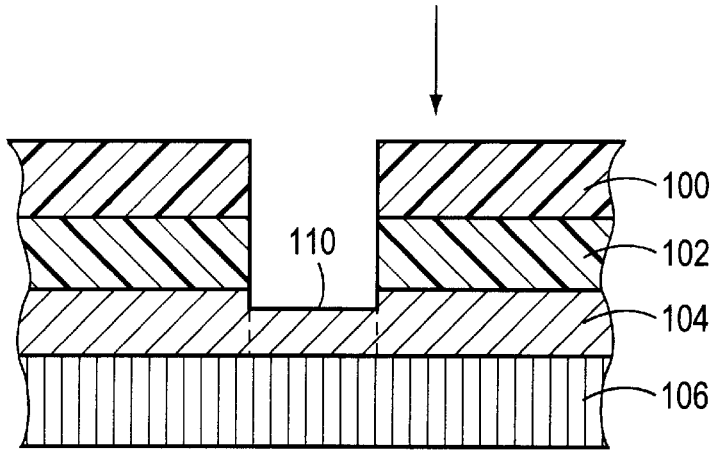
Figure 3D:
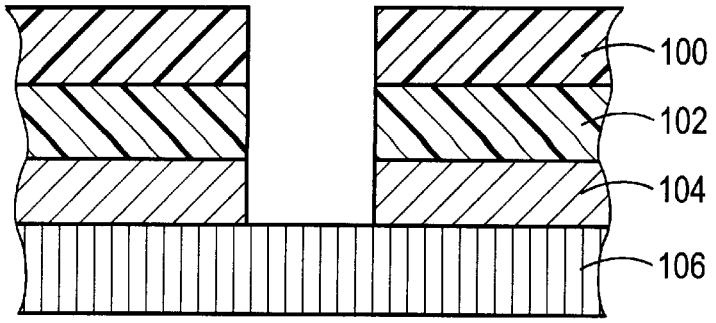

Referring now to FIG. 3A, which illustrates a preferred embodiment of a lithographic printing member in accordance with the present invention, the printing member comprises an ink-accepting and durable surface layer 100 characterized by the absence of ablative absorption of imaging radiation, an ablative-absorbing second layer 102, a hydrophilic third layer 104, and a hydrophilic metal substrate 106.

The primary characteristics of ink-accepting surface layer 100 are its oleophilicity and hydrophobicity, resistance to solubilization by water and solvents, and durability on the printing press. Suitable polymers utilized in this layer should have relatively low decomposition temperatures to assist in the heat-induced ablative imaging initiated in the ablative-absorbing second layer 102, excellent adhesion to the ablative-absorbing second layer 102, and high wear resistance. They may be either water-based or solvent-based polymers. Ink-accepting surface layer 100 should also, upon imaging, produce environmentally and toxicologically innocuous decomposition by-products. This layer also may include a crosslinking agent which provides improved bonding to the ablative-absorbing second layer 102 and increased durability of the plate for longer print runs if post baked after cleaning.

Suitable polymers include, but are not limited to, polyurethanes, cellulosics such as nitrocellulose, polycyanoacrylates, and epoxy polymers. For example, polyurethane materials are typically extremely tough and may have thermosetting or self-curing capability. An exemplary coating layer may be prepared by mixing and coating methods known in the art, for example, wherein a mixture of polyurethane polymer and hexamethoxymethylmelamine crosslinking agent in a suitable solvent, water, or solvent-water blend is combined, followed by the addition of a suitable amine-blocked p-toluenesulfonic acid catalyst to form the finished coating mix. The coating mix is then applied to the ablative-absorbing second layer 102 using one of the conventional methods of coating application, such as wire wound rod coating, reverse roll coating, gravure coating, and slot die coating, and subsequently dried to remove the volatile liquids and to form a coating layer. Polymeric systems containing components in addition to polyurethane polymers may also be combined to form the ink-accepting surface layer 100. For example, an epoxy polymer may be added to a polyurethane polymer in the presence of a crosslinking agent and a catalyst.

Ink-accepting surface layer 100 is coated in this invention typically to a dry thickness in the range of from about 0.1 to about 20 microns and, more preferably, in the range of from about 0.1 to about 2 microns. After coating, the layer is dried and preferably cured at a temperature of between 145° C. and 165° C.

The ablative-absorbing, ink-accepting second layer 102 of this aspect of the present invention is as described herein for the ablative-absorbing, ink-accepting surface layer 102 of the wet lithographic printing members without three layers or without a non-ablative-absorbing surface layer overlying the ablative-absorbing layer.

The hydrophilic third layer 104 of this aspect of the present invention is as described herein for the hydrophilic second layer 104 of the wet lithographic printing members without three layers or without a non-ablative-absorbing surface layer overlying the ablative-absorbing layer.

The hydrophilic metal substrate 106 of this aspect of the invention is as described herein for the hydrophilic metal substrate 106 of the wet lithographic printing members without three layers or without a non-ablative-absorbing surface layer overlying the ablative-absorbing layer.

Imaging Apparatus

The laser-induced ablation of the positive working, wet lithographic printing members of the present invention may be carried out using a wide variety of laser imaging systems known in the art of laser-induced ablation imaging, including, but not limited to, the use of continuous and pulsed laser sources, and the use of laser radiation of various infrared wavelengths. Preferably, the laser-induced ablation of this invention is carried out utilizing a continuous laser source of near-infrared radiation, such as, for example, with a diode laser emitting at 830 nm.

Imaging apparatus suitable for use in conjunction with the present invention include, but are not limited to, known laser imaging devices such as infrared laser devices like the CREO Trendsetter, the PRESSTEK Pearlsetter, and the GERBER Crescent 42T that emit in the infrared spectrum. Laser outputs can be provided directly to the plate surface via lenses or other beam-guiding components, or transmitted to the surface of a printing plate from a remotely located laser using a fiber-optic cable. The imaging apparatus can operate on its own, functioning solely as a platemaker, or it can be incorporated directly into a lithographic printing press. In the latter case, printing may commence immediately after application of the image to a blank plate. The imaging apparatus can be configured as a flatbed recorder or as a drum recorder.

Imaging Techniques

In operation, the plates of the present invention are imaged in accordance with methods well-known to those of ordinary skill in the art. Thus, a lithographic printing plate of the present invention is selectively exposed, in a pattern representing an image, to the output of an imaging laser which is scanned over the plate. Referring to FIG. 2B, radiative laser output removes and/or damages or transforms the ablative-absorbing surface layer 102, thereby directly producing on the plate an array of image features or potential image features.

FIGS. 2A, 2B, 2C, and 2D show this imaging process in greater detail. As shown in FIG. 2B, imaging radiation partially removes surface layer 102, leaving a layer of residual debris 108 on the hydrophilic second layer 104. The laser-imaged plate is then cleaned with water or fountain solution in order to remove debris 108, thereby exposing the surface of the hydrophilic second layer 104, as shown in one embodiment in FIG. 2C. Depending upon the damage to hydrophilic second layer 104 during imaging, some or all of hydrophilic second layer 104 is removed during cleaning. When the plate is imaged and placed on the press without cleaning with water, debris 108 is carried by the conveying rollers back to the bulk source of fountain solution. During printing, the imaged and cleaned plate is subjected to fountain solution and press wear that will remove additional portions of the remaining exposed hydrophilic second layer 104. The printing members of the present invention provide a useful combination of better adhesion and easier cleaning and removal of the layer of residual debris to reduce the damage to either the surface layer 102 or the unexposed second layer 104 lying thereunder, as shown in one embodiment in FIG. 2D, when running on press. This reduces the amount and rate of undercutting of the ink-accepting printing image areas by the fountain solution and allows increased length of the press runs before image quality deteriorates.

FIGS. 3A, 3B, 3C, and 3D show this imaging process for a preferred embodiment with three layers on the hydrophilic metal substrate. As shown in one embodiment in FIG. 3B, imaging radiation removes ink-accepting, non-ablative absorbing surface layer 100 and partially removes ablative-absorbing second layer 102, leaving a layer of residual debris 108 on the hydrophilic third layer 104. The laser-imaged late is then cleaned with water or fountain solution in order to remove the layer of debris 108, thereby exposing the surface of the hydrophilic third layer 104, as shown in one embodiment in FIG. 3C. Depending upon the damage to hydrophilic third layer 104 during imaging, some or all of layer 104 is removed during cleaning. The plate is then further subjected to press fountain solution which will remove additional portions of the remaining exposed hydrophilic third layer 104. When the plate is imaged and placed on the press without cleaning with water, debris 108 is carried by the conveying rollers back to the bulk source of fountain solution. This embodiment of the present invention with three layers further reduces damage to the ink-accepting printing image areas during the press run by improving the wear properties of the imaged plate on the press, by providing improved durability and resistance to the press and fountain solution, by providing improved scratch resistance to better avoid damage during handling and use, and by providing better oleophilicity and hydrophobicity than is normally achieved with ablative-absorbing surface layers, which have the disadvantage of being formulated with high weight percent loadings of the laser sensitizing chemicals and of polymers designed for effective heat-induced ablative decomposition.

Thus, in one aspect of the invention, a method of preparing an imaged wet lithographic printing plate is provided, which method comprises the steps of (a) providing a positive working, wet lithographic printing member with two layers on the substrate, wherein the surface layer is an ablative-absorbing, ink-accepting layer and the second or intermediate layer interposed between the ablative-absorbing surface layer and the hydrophilic metal substrate is a hydrophilic layer, as described herein; (b) exposing the printing member to a desired imagewise exposure of laser radiation to ablate the surface layer of the member to form a residual debris layer in the laser-exposed areas of the surface layer, which residual layer is in contact to the hydrophilic layer; and, (c) cleaning the residual layer from the hydrophilic layer with a cleaning solution; wherein the hydrophilic layer is characterized by removal of at least a portion of the hydrophilic layer in the laser-exposed areas in steps (b) and (c).

In another aspect of the present invention, a method of preparing an imaged wet lithographic printing plate is provided, which method comprises the steps of (a) providing a positive working, wet lithographic printing member with three layers on the substrate wherein the surface layer is a non-ablative-absorbing layer overlying an ablative-absorbing second layer and a hydrophilic layer is interposed between the ablative-absorbing second layer and the hydrophilic metal substrate, as described herein; (b) exposing the printing member to a desired imagewise exposure of laser radiation to ablate the surface and second layers of the member to form a residual debris layer in the laser-exposed areas of the ablative-absorbing second layer, which residual layer is in contact to the hydrophilic third layer; and, (c) cleaning said residual layer from the hydrophilic third layer with a cleaning solution; wherein the hydrophilic third layer is characterized by removal of at least a portion of the hydrophilic third layer in the laser-exposed areas during steps (b) and (c).

EXAMPLES

Several embodiments of the present invention are described in the following examples, which are offered by way of description and not by way of limitation.

Example 1

Lithographic printing plates according to a preferred embodiment of the invention were prepared using a brush grained, electrochemically etched, and anodized aluminum sheet with a silicate over layer as hydrophilic metal layer 106.

A. Hydrophilic Layer 104

The following components shown on a dry weight basis for the solids were mixed in water to make a 6.3% by weight solution:

| Component | Parts | Source |
|---|---|---|
| Polyvinyl alcohol polymer | 6.25 | AIRVOL 125 |
| Ammonium zirconyl carbonate | 2.50 | BACOTE 20 |
| Glycerol | 0.25 | Aldrich Chemical, Milwaukee, WS |
| Surfactant | 0.10 | TRITON X-100, Rohm & Haas |

This solution was applied to the above aluminum sheet with a #18 wire wound rod and then dried for 2 minutes at 145° C.

B. Ablative-Absorbing, Ink Accepting Layer 102

The following components were mixed in water to make an 8.3% dispersion:

| Component | Parts* | Source |
|---|---|---|
| Polyvinyl Alcohol | 2.20 | AIRVOL 125 |
| Vinyl Copolymer | 2.10 | UCAR WBV-110 |

-continued

| Component | Parts* | Source |
|---|---|---|
| Hexamethoxymethyl Melamine | 1.21 | CYMEL 303 |
| Sulfonated Carbon Black | 2.48 | CAB-O-JET 200 |
| P-Toluenesulfonic Acid | 0.30 | NACURE 2530 (25% active) |

*Parts by weight in dried coating.

This dispersion was applied on top of the hydrophilic barrier coated aluminum sheet of Part A of this Example, with a #4 wire wound rod and dried for 2 minutes at 145° C.

C. Ink Accepting Layer 100—Water-Based Coating

The following dispersion was applied to the above coated aluminum sheet with a #4 wire rod and dried for 2 minutes at 145° C:

| Component | Parts* | Source |
|---|---|---|
| Aqueous polyurethane dispersion | 5.0 | WITCOBOND W-240 (30% solid) |
| Hexamethoxymethyl-melamine | 1.0 | CYMEL 303 |
| Amine blocked p-toluene sulfonic Acid | 0.5 | Nacure 2530 (25% active) |
| Water | 93.5 | |

*Parts by hundred in wet coating

Four plates prepared in the above manner were imaged on a Presstek PEARLSETTER 74 containing IR laser diodes emitting energy at 870 nm. The laser spot size was 35 microns. Energy used to image the plates was approximately between 500 and 700 mj/cm$^2$. After imaging, the exposed area of the plate appeared as faint gray contrasted to a black image area. Two exposed plates were cleaned in an Anitec desktop plate processor using water as the cleaning liquid. One was mounted and run on a sheet-fed press, and the second was mounted and run on a web press. One uncleaned exposed plate was mounted directly on the web press and run. The other was mounted directly on the sheet fed press and run. The presses were stopped every 10,000 impressions and the plates cleaned with TRUE BLUE plate cleaner. Press runs were evaluated for speed of rollup (no. of impressions until acceptable printing), ink receptivity, ink discrimination, scumming, wear characteristics, run length, and resolution.

The results are summarized in Table 1.

TABLE 1

| | Precleaned | Press type | Rollup | Scumming | Run Length | Resolution |
|---|---|---|---|---|---|---|
| Plate 1 | Yes | Web | 30 | None | 120,000 | 3–97% |
| Plate 2 | No | Web | 40 | None | 120,000+ | 3–97% |
| Plate 3 | Yes | Sheet | 5 | None | 100,000 | 3–97% |
| Plate 4 | No | Sheet | 5 | None | 100,000 | 3–97% |

Example 2

Lithographic printing plates in accordance with the invention were prepared using a grained and anodized aluminum sheet with a silicate overlayer. The aluminum sheet was coated with a hydrophilic layer, as in Part A of Example 1. The following ablative-absorbing second layer was coated using a #4 wire wound rod on the cured hydrophilic polymeric layer and cured for 120 seconds at 145° C.

| Component | Parts |
|---|---|
| AIRVOL 125 (5% solids in water) | 30.00 |
| WITCOBOND 240 (30% solids in water) | 10.00 |
| 2-Butoxyethanol | 2.50 |
| CYMEL 303 | 1.25 |
| CAB-O-JET 200 (20% solids in water) | 16.50 |
| TRITON X-100 (10% solids in water) | 2.40 |
| NACURE 2530 (25% PTSA) | 0.80 |
| Water | 36.50 |

An ink-accepting surface layer from a water-based formulation was then overcoated using a #3 wire wound rod upon the second layer The sample was then cured for 120 seconds at 145° C. The water-based coating formulation for the ink-accepting surface layer was as follows:

| Component | Parts |
|---|---|
| WITCOBOND W-240 (30% solids in water) | 11.4 |
| 2-Butoxyethanol | 1.0 |
| CYMEL 303 | 1.2 |
| NACURE 2530 (25% PTSA) | 2.4 |
| TRITON X- I 00 (10% solids in water) | 1.0 |
| Water | 83.0 |

The plate was imaged on a PEARLSETTER 74 as in Example 1. The laser energy at the plate surface was approximately 700 mj/cm$^2$. Plates were cleaned through an Anitec desktop plate processor using water as the cleaning liquid. After cleaning with water, the plates were evaluated for ease of cleaning, diode banding, resolution, and wet rub resistance. Diode banding is a measure of the latitude of the imaging sensitivity due to variations in output among the different IR laser diodes, coating thickness variations, and other variables. A low degree of banding is highly desirable in order to obtain uniform printing images. Resolution is a measure of the finest lines or dots of imaging quality that are achieved on the plate after imaging and post-imaging cleaning. Wet rub resistance is a measure of the finest lines or dots of imaging quality that are maintained on the plate during press operation and is estimated by measuring the finest lines or dots on the plate that survive 50 wet rubs with a WEBRIL cloth, a trademark for a lint-free cloth available from Veratec Corporation, Walpole, Mass. which has been wet with water. The wet rubs each involve a double pass back and forth across the imaged areas so that 50 wet rubs in the wet rub resistance tests of this invention actually involve a total of 100 passes or wet rubs across the imaged area.

In the resolution and wet rub resistance testing of this invention, the image areas are of two types: (1) narrow lines in the form of a series of pixels with the width of the lines based on the number of pixels comprising the width, and (2) half tone dots at 150 lines per inch (lpi) halftone screen imaging. Approximate sizes of these image areas are as follows. One pixel lines are 15 microns wide, and 3 pixel lines are 40 microns wide. 2% Dots are 15 microns in diameter, 3% dots are 20 microns in diameter, 4% dots are 25 microns in diameter, 5% dots are 35 microns in diameter, and 10% dots are 60 microns in diameter. The smaller the widths of the pixel lines and the smaller the diameters of the dot sizes that can be achieved and maintained on the plate the better the printing quality and press run length with acceptable quality. Thus, achieving a 1 pixel wide line image after cleaning and maintaining the 1 pixel wide line image through the wet rub resistance test is the best result for printing quality. Similarly, achieving a 2% dot image or a dot that is about 15 microns in diameter after cleaning and maintaining the 2% dot image through the wet rub resistance test is the best result for printing quality, and much more desirable compared to maintaining only 5% or 10% dots as the best dot images. After cleaning and applying the wet rub resistance test, Example 2 maintained 1 pixel lines, 2% dots after cleaning, and 3% to 4% dots after 50 wet double rubs. Banding was moderate. The non-image area of the plate was clean.

Example 3

In a preferred embodiment, a lithographic printing plate was prepared in accordance with the invention using a special grained aluminum. The surface of the aluminum sheet has a peak count in the range of 300 to 450 peaks per linear inch which extend above and below a total bandwidth of 20 micro inches. This aluminum is available from Alcoa, Inc. as SATIN FINISH aluminum. The grained surface is anodized and then provided with a silicate overlayer. The aluminum sheet was coated with a hydrophilic layer, as in Part A of Example 1. The following ablative-absorbing surface layer was coated using a #4 wire wound rod on the cured hydrophilic polymeric layer and cured for 120 seconds at 145° C.

| Component | Parts |
|---|---|
| AIRVOL 125 (5% solids in water) | 30.00 |
| WITCO 240 (30% solids in water) | 10.00 |
| 2-Butoxyethanol | 2.50 |
| CYMEL 303 | 1.25 |
| BONJET BLACK CW-1 (20% solids in water) | 6.50 |
| TRITON X-100 (10% solids in water) | 2.40 |
| NACURE 2530 (25% PTSA) | 0.80 |
| Water | 36.50 |

The plate was imaged on a PEARLSETTER 74 containing IR laser diodes emitting energy at 830 nm. The laser spot size was 28 microns. The laser energy at the plate surface was approximately 700 mj/cm$^2$ Plates were cleaned through an Anitec desktop plate processor using water as the cleaning liquid. After cleaning, the plate maintained 1 pixel lines and 2% dots. After applying the wet rub resistance test, the plate maintained 5% dots and three pixel lines. Banding was excellent. The non-image area of the plate was clean.

Example 4

A second lithographic printing plate was prepared in accordance with the formula and procedure shown in Example 3. An ink-accepting surface layer from a water-based formulation was then overcoated onto layer 102 of this plate using a #3 wire wound rod. The plate was then cured for 120 seconds at 145° C. The water-based coating formulation for the ink-accepting surface layer was as follows:

| Component | Parts |
|---|---|
| WITCOBOND W-240 (30% solids in water) | 11.4 |
| 2-Butoxyethanol | 1.0 |
| CYMEL 303 | 1.2 |
| NACURE 2530 (25% PTSA) | 2.4 |

-continued

| Component | Parts |
|---|---|
| TRITON X-100 (10% in water) | 1.0 |
| Water | 83.0 |

The plate was imaged on a PEARLSETTER 74 as in Example 3. Plates were cleaned through an Anitec desktop plate processor using water as the cleaning liquid.

After cleaning, the plate maintained 1 pixel lines and 2% dots. After applying the wet rub resistance test, the plate maintained 3% dots and one pixel lines. Banding was moderate. The non-image area of the plate required extra cleaning to remove the residual composite layer. This indicated that the plate required slightly higher exposure energy.

While the invention has been described in detail and with reference to specific embodiments thereof, it will be apparent to one skilled in the art that various changes and modifications can be made without departing from the spirit and scope thereof.

What is claimed is:

1. A positive-working, wet lithographic printing member imageable by laser radiation, said member comprising:

(a) an ink-accepting surface layer comprising one or more polymers and being characterized by the absence of ablative absorption of said laser radiation;

(b) an ink-accepting second layer underlying said surface layer, said second layer comprising one or more polymers and a sensitizer, said sensitizer being characterized by absorption of said laser radiation and said second layer being characterized by ablative absorption of said laser radiation;

(c) a hydrophilic third layer underlying said second layer, said third layer comprising one or more polymers and being characterized by the absence of ablative absorption of said laser radiation; and (d) a hydrophilic metal substrate;

wherein said third layer is further characterized by (i) being compatible with but not excessively soluble in water and by being at least partially removed by said laser radiation and a subsequent cleaning treatment with water, and (ii) providing a thermal barrier between the second layer and the substrate.

2. The member of claim 1, wherein one or more polymers of said surface layer comprises a crosslinked, polymeric reaction product of a polymer and a crosslinking agent.

3. The member of claim 2, wherein one or more polymers of said surface layer is selected from the group consisting of:

polyurethanes; cellulosics; polycyanoacrylates; and epoxy polymers.

4. The member of claim 2, wherein said crosslinked reaction product is selected from the group consisting of:

crosslinked polymer reaction products of a polyurethane and a melamine; and crosslinked polymer reaction products of a polyurethane, an epoxy polymer, and a crosslinking agent.

5. The member of claim 2, wherein said crosslinking agent is a melamine.

6. The member of claim 2, wherein said surface layer further comprises a catalyst.

7. The member of claim 6, wherein said catalyst is an organic sulfonic acid component.

8. The member of claim 7, wherein said organic sulfonic acid component of said surface layer is a component of an amine-blocked organic sulfonic acid.

9. The member of claim 1, wherein said surface layer is further characterized by being not soluble in water or in a cleaning solution.

10. The member of claim 1, wherein the thickness of said surface layer is from about 0.1 microns to about 20 microns.

11. The member of claim 1, wherein the thickness of said surface layer is from about 0.1 to about 2 microns.

12. The member of claim 1, wherein said second layer comprises a carbon black selected from the group consisting of:

sulfonated carbon blacks having sulfonated groups on the surface of the carbon black, carboxylated carbon blacks having carboxylated groups on the surface of the carbon black, and carbon blacks having a surface active hydrogen content of not less than 1.5 mmol/g.

13. The member of claim 1, wherein said second layer comprises a polyvinyl alcohol.

14. The member of claim 13, wherein said polyvinyl alcohol is present in an amount of 20 to 95 percent by weight of the total weight of polymers present in said second layer.

15. The member of claim 13, wherein said polyvinyl alcohol is present in an amount of 25 to 75 percent by weight of the total weight of polymers present in said second layer.

16. The member of claim 13, wherein said second layer comprises one or more polymers selected from the group consisting of:

polyurethanes; cellulosics; epoxy polymers; and vinyl polymers.

17. The member of claim 13, wherein one or more polymers of said second layer comprises a crosslinked polymeric reaction product of a polymer and a crosslinking agent.

18. The member of claim 17, wherein said crosslinked reaction product is selected from the group consisting of:

crosslinked reaction products of a polyvinyl alcohol and a crosslinking agent; crosslinked reaction products of a polyvinyl alcohol, a vinyl polymer, and a crosslinking agent; crosslinked reaction products of a cellulosic polymer and a crosslinking agent; crosslinked reaction products of a polyurethane and a crosslinking agent; crosslinked reaction products of an epoxy polymer and a crosslinking agent; and crosslinked reaction products of a vinyl polymer and a crosslinking agent.

19. The member of claim 17, wherein said crosslinking agent is a melamine.

20. The member of claim 1, wherein the thickness of said second layer is from about 0.1 microns to about 20 microns.

21. The member of claim 1, wherein the thickness of said second layer is from about 0.1 to about 2 microns.

22. The member of claim 1, wherein the thickness of said third layer is from about 1 to about 40 microns.

23. The member of claim 1, wherein the thickness of said third layer is from about 2 to about 25 microns.

24. The member of claim 1, wherein said third layer comprises a crosslinked, polymeric reaction product of a hydrophilic polymer and a crosslinking agent.

25. The member of claim 24, wherein said hydrophilic polymer is selected from the group consisting of polyvinyl alcohols and cellulosics.

26. The member of claim 24, wherein said hydrophilic polymer is polyvinyl alcohol.

27. The member of claim 1, wherein said metal substrate is selected from the group of metals consisting of:

aluminum, copper, steel and chromium.

28. The member of claim 27, wherein said metal substrate is grained, anodized, silicated, or a combination thereof.

29. The member of claim 1, wherein said metal substrate is aluminum.

30. The member of claim 29, wherein said aluminum substrate comprises a surface of uniform, non-directional roughness and microscopic depressions, which surface is in contact with said hydrophilic layer.

31. The member of claim 30, wherein said surface of said aluminum substrate has a peak count in the range of 300 to 450 peaks per linear inch which extend above and below a total bandwidth of 20 microinches.

32. A method of preparing an imaged wet lithographic printing plate, said methods comprising the steps of:

(a) providing a wet lithographic printing member according to claim 1;

(b) exposing said member to a desired imagewise exposure of laser radiation to ablate said surface and second layers of said member to form a residual layer in the laser-exposed areas of said second layer, said residual layer being in contact with said third layer; and, (c) cleaning said residual layer from said third layer with a cleaning solution;

wherein said third layer is characterized by removal of at least a portion of said third layer in said laser-exposed areas during steps (b) and (c).

33. A positive working, wet lithographic printing member imageable by laser radiation, said member comprising:

(a) an ink-accepting, hydrophobic surface layer comprising one or more polymers and being characterized by the absence of ablative absorption of said laser radiation and further characterized by being compatible with but not soluble in a cleaning solution;

(b) an ablative layer underlying said surface layer, said ablative layer being characterized by ablative absorption of said laser radiation and by being compatible with but not excessively soluble in the cleaning solution;

(c) a hydrophilic layer underlying said ablative layer, said hydrophilic layer comprising one or more polymers and being characterized by the absence of ablative absorption of said laser radiation; and (d) a hydrophilic metal substrate characterized by being insoluble in the cleaning solution;

wherein said hydrophilic layer is further characterized by (i) being compatible with but not excessively soluble in water and by being at least partially removed by said laser radiation and a subsequent cleaning treatment with water or with the cleaning solution, and (ii) providing a thermal barrier between the ablative layer and the substrate.

34. A method of preparing an imaged wet lithographic printing plate, said method comprising the steps of:

(a) providing a wet lithographic printing member according to claim 33;

(b) exposing said member to a desired imagewise exposure of laser radiation to ablate said surface and second layers of said member to form a residual layer in the laser-exposed areas of said ablative layer, said residual layer being in contact with said third layer; and, (c) cleaning said residual layer from said third layer with a cleaning solution;

wherein said third layer is characterized by removal of at least a portion of said third layer in said laser-exposed areas during steps (b) and (c).

35. A method of preparing a positive working, wet lithographic printing member imageable by laser radiation, said method comprising the steps of:

(a) providing a hydrophilic metal substrate;

(b) forming a hydrophilic layer on said substrate, said hydrophilic layer comprising one or more polymers and being characterized by the absence of ablative absorption of said laser radiation;

(c) forming an intermediate layer overlying said hydrophilic layer, said intermediate layer comprising one or more polymers and a sensitizer, said sensitizer being characterized by absorption of said laser radiation and said intermediate layer being characterized by ablative absorption of said laser radiation; and (d) forming an ink-accepting layer overlying said intermediate layer, said ink-accepting layer comprising one or more polymers and being characterized by the absence of ablative absorption of said laser radiation;

wherein said hydrophilic layer is further characterized by (i) being compatible with but not excessively soluble in water and by being at least partially removed by said laser radiation and subsequent cleaning treatment with water, and (ii) providing a thermal barrier between the intermediate layer and the substrate.

36. A method of preparing a positive working, wet lithographic printing member imageable by laser radiation, said method comprising the steps of:

(a) providing a hydrophilic metal substrate;

(b) forming a hydrophilic layer on said substrate, said hydrophilic layer comprising one or more polymers and being characterized by the absence of ablative absorption of said laser radiation and by being compatible with but not excessively soluble in a cleaning solution;

(c) forming an ablative layer overlying said hydrophilic layer, said ablative layer being characterized by ablative absorption of said laser radiation and by being compatible with but not excessively soluble in the cleaning solution; and (d) forming an ink-accepting, hydrophobic layer overlying said ablative layer, said ink-accepting layer comprising one or more polymers and being characterized by the absence of ablative absorption of said laser radiation and by being compatible with but not soluble in the cleaning solution;

wherein said hydrophilic layer is further characterized by (i) being slightly soluble but not excessively soluble in water and by being at least partially removed by said laser radiation and subsequent cleaning treatment with water, and (ii) providing a thermal barrier between the ablative layer and the substrate.

* * * * *